US007232329B1

(12) United States Patent
Wu

(10) Patent No.: US 7,232,329 B1
(45) Date of Patent: Jun. 19, 2007

(54) CABLE CONNECTOR ASSEMBLY WITH UNITARY LATCH

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/481,261

(22) Filed: Jul. 5, 2006

(51) Int. Cl.
*H01R 13/627* (2006.01)

(52) U.S. Cl. ..... 439/358

(58) Field of Classification Search ..... 439/358, 439/354, 353, 350
See application file for complete search history.

(56) References Cited

U.S. PATENT DOCUMENTS

| | | | | |
|---|---|---|---|---|
| 4,986,766 | A | 1/1991 | Leonard et al. | |
| 5,030,127 | A * | 7/1991 | Blasko et al. | 439/353 |
| 6,109,955 | A * | 8/2000 | Hanazaki et al. | 439/489 |
| 6,179,643 | B1 * | 1/2001 | Fukuda | 439/358 |
| 6,364,685 | B1 | 4/2002 | Manning | |
| 6,431,887 | B1 | 8/2002 | Yeomans et al. | |
| 6,439,915 | B2 * | 8/2002 | Kurimoto | 439/352 |
| 6,475,014 | B2 * | 11/2002 | Tsuji et al. | 439/352 |
| 6,585,536 | B1 | 7/2003 | Wu | |
| 6,585,537 | B1 | 7/2003 | Lee | |
| 6,595,793 | B2 * | 7/2003 | Tsuji et al. | 439/352 |
| 6,655,979 | B1 | 12/2003 | Lee | |
| 6,821,139 | B1 | 11/2004 | Wu | |
| 6,830,472 | B1 | 12/2004 | Wu | |
| 6,857,912 | B2 | 2/2005 | Wu | |
| 6,860,749 | B1 * | 3/2005 | Wu | 439/352 |
| 6,860,750 | B1 | 3/2005 | Wu | |
| 6,890,205 | B1 | 5/2005 | Wu | |
| 6,896,540 | B1 | 5/2005 | Wu | |
| 6,926,553 | B2 | 8/2005 | Wu | |
| 7,033,201 | B2 * | 4/2006 | Ichida et al. | 439/352 |
| 2005/0101176 | A1 | 5/2005 | Molex | |
| 2006/0009080 | A1 | 1/2006 | Molex | |
| 2006/0014438 | A1 | 1/2006 | Molex | |
| 2006/0019525 | A1 | 1/2006 | Molex | |
| 2006/0040556 | A1 | 2/2006 | Molex | |

OTHER PUBLICATIONS

"SFF-S087 Specification for Compact Multilane Unshielded Connector" Rev. 1.31, published on Jun. 27, 2005 by SFF Committee.

* cited by examiner

*Primary Examiner*—Micheal C. Zarroli
*Assistant Examiner*—Phuongchi Nguyen
(74) *Attorney, Agent, or Firm*—Wei Te Chung

(57) ABSTRACT

A cable connector assembly (100) includes a housing defining a mating interface, a printed circuit board (3) received in the housing, and defining a mating portion (30) accessible from the mating interface (11), a cable (4) with a number of conductors electrically attached to the printed circuit board and a latch (5) unitarily molded with the connector housing.

13 Claims, 7 Drawing Sheets

CABLE CONNECTOR ASSEMBLY WITH UNITARY LATCH

CROSS-REFERENCE TO RELATED APPLICATION

This application is related to U.S. patent application Ser. No. 11/268,951 filed on Nov. 7, 2005, entitled "CABLE CONNECTOR ASSEMBLY WITH INTEGRAL PRINTED CIRCUIT BOARD", U.S. patent application Ser. No. 11/322,413 filed on Dec. 30, 2005, entitled "CABLE CONNECTOR ASSEMBLY WITH INTEGRAL PRINTED CIRCUIT BOARD", U.S. patent application Ser. No. 11/166,673 filed on Jun. 23, 2005, entitled "CABLE ASSEMBLY HAVING IMPROVED LATCH", all of are invented by Jerry Wu, and assigned to the same assignee as this application.

BACKGROUND OF THE INVENTION

1. Field of the Invention

The present invention relates to a cable connector assembly, and more particularly to a cable connector assembly used for high-speed signal transmission.

2. Description of Related Art

A committee called SFF is an ad hoc group formed to address storage industry needs in a prompt manner. When formed in 1990, the original goals were limited to define de facto mechanical envelopes within disk drives can be developed to fit compact computer and other small products. Specification SFF-8087 defines physical interface and general performance requirements of the mating interface for a Compact Multilane Connector which is designed for using in high speed serial interconnect applications at speeds up to 10 Gigabits/second. The Compact Multilane Connector defined in the SFF-8087 comprises a printed circuit board, a plurality of high-speed cables and low-speed wires respectively electrically connected with the printed circuit board to form a plurality of junctions therebetween, a PVC housing overmolding to the printed circuit board and the cables. The PVC housing comprises a rectangular body portion enclosing the junctions and a pair of tongue portions respectively extending forwardly from the body portion. The front portion of the printed circuit board is exposed between the pair of tongue portions for electrically connecting with a complementary connector. The Compact Multilane Connector also comprises a latch member assembled to a top surface of the body portion of the housing for latching with the complementary connector.

For example, U.S. Pub. No. 2006/0019525A1 which published on Jan. 26, 2006 and assigned to Molex shows a conventional Compact Multilane Connector comprising a two-piece connector housing, a printed circuit board received in the housing, a cable electrically connected to the printed circuit board, and a generally U-shaped actuator connected to the housing. The actuator comprises a pair of cam blocks accessible from exterior space and releasably engaging with a complementary connector for mating/unmating the Compact Multilane Connector with the complementary connector.

For example, U.S. Pub. No. 2006/0009080A1 which published on Jan. 12, 2006 and assigned to Molex shows a conventional Compact Multilane Connector (labeled 550, shown in FIG. 22) comprising a unitary housing, a printed circuit board received in the housing. The housing defines a mating interface forwardly extending therefrom and formed by a pair of tongue portions and an interspace between the pair of tongue portions, a mating port of the printed circuit board is accessible from the mating interface.

For example, U.S. Pub. No. 2005/0101176 A1 published on May 12, 2005 shows a Serial ATA Connector. The connector comprises a connector housing with a plurality of contacts therein and defining a pair of anti-overstress arms, a cable connected to the contacts, a latch assembled to an external wall of the housing. The latch is formed of metal, and formed of a first leg and a second leg which form a substantially "V" shape when viewed in side elevation. The second leg further comprises a pair of portions sidewardly extending therefrom and positioned underneath the anti-overstress arms for preventing the latch being outwardly pushed excessively. In addition, U.S. Pat. No. 4,986,766, cited by U.S. Pub. No. 2005/0101176 A1 as prior art, shows an electrical connector with structure similar to that of U.S. Pub. No. 2005/0101176 A1 and with an essential difference that the latch is molded with the housing in U.S. Pat. No. 4,986,766.

For example, Another U.S. Pat. No. 6,364,685 B1 which issued on Apr. 2, 2002 also shows an electrical connector having an articulated latch. The articulated latch comprises a first section with a proximate end being joined to the forepart of the housing, a second section downwardly and inwardly extending from the first section with a distal end being joined to/being departed from the surface of the housing. When the latch is actuated, the first section and the second section move to maintain a substantially parallel relationship, which all have trendy to return to their original positions, thereby, increasing the latch's restorative force and causing the engagement structure of the housing to mate with the complementary connector more conveniently. The first section and the second section are arranged in a vertical plane, as the latch is actuated, the first section will abut against the second section, thereby, taking up much space in the horizontal direction between the latch and the surface of the housing and preventing the latch being actuated adequately.

In present invention, an improved cable connector assembly is provided.

SUMMARY OF THE INVENTION

An object of the present invention is to provide a cable connector assembly having an improved latch for mating with a complementary connector more reliably.

Another object of the present invention is to provide a cable connector assembly having unitary latch molded with the connector housing for producing the same conveniently.

To achieve the above objects, a cable connector assembly in accordance with the present invention comprises a housing defining a mating interface, a printed circuit board received in the housing and defining a mating portion accessible from the mating interface, a cable with a plurality of conductors electrically attached to the printed circuit board and a latch unitarily molded with the connector housing.

Other objects, advantages and novel features of the invention will become more apparent from the following detailed description when taken in conjunction with the accompanying drawings.

DETAILED DESCRIPTION OF THE INVENTION

Figure 1:
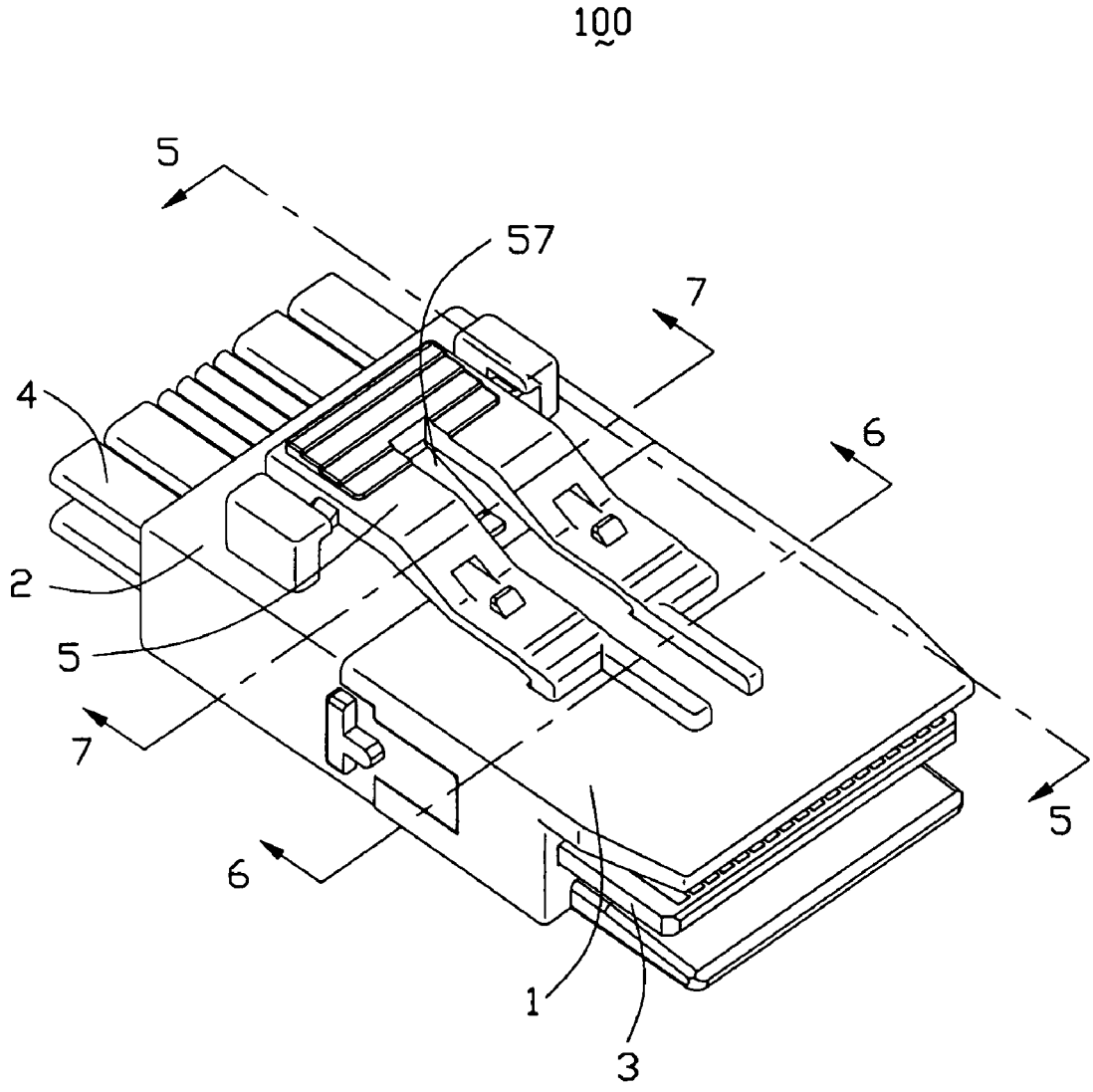
FIG. 1 is an assembled, perspective view of a cable connector assembly in accordance with the present invention.

Referring to FIGS. 1 to 4, a cable connector assembly 100 in accordance with the present invention comprises a connector housing (not labeled) defining a mating direction, and including a front first housing piece 1 and a rear second housing piece 2, a printed circuit board 3 assembled to the connector housing, a plurality of cables 4 electrically connected to the printed circuit board 3, a pin member 6 assembled to the connector housing for holding the printed circuit board 3 with the connector housing reliably, and a resilient latch 5 unitarily molded with the connector housing for attaching the cable connector assembly 100 with a complementary connector (not shown).

Referring to FIGS. 1–7, the first housing piece 1 is made of insulative material with enough rigidity. The first housing piece 1 comprises a rectangular body portion 10 defining a central receiving slot 101 therethrough, and a pair of tongue sections 110, 111 opposite to each other and respectively extending forwardly from a front surface of the body portion 10. The tongue sections 110, 111, together with an opening 112 defined between the pair of the tongue sections 110, 111, form a mating interface 11 of the first housing piece 1.

The body portion 10 comprises an upper wall 12, a lower wall 13 opposite to the upper wall 12, and a pair of lateral walls 14 connected to the upper and lower walls 12, 13. These walls 12, 13 and 14 together define a receiving space (not labeled) recessed a predetermined distance to communicate with the receiving slot 101. The receiving space defines a first receiving cavity 105, and a second receiving cavity 106 located adjacent to and larger than the first receiving cavity 105, thereby forming a step configuration in inner surface of the lower wall 13 and the upper wall 12. The inner surface of the lower wall and upper wall 13, 12 aligned with the first receiving cavity 105 define a plurality of semi-circular holes 1051 (shown in FIG. 6) therein. The lateral walls 14 respectively define a cutout 140 to communicate with the receiving space. In addition, the upper wall 12 extends rearwardly beyond the lower wall 13 a predetermined distance along the mating direction and forms a step portion 120. The base portion 10 comprises a rectangular slot 102 (shown in FIG. 3) communicated with the receiving slot 101 and located adjacent to the mating interface 11. The lower wall 13 defines a depressed opening 130 depressed a predetermined distance from a surface thereof. The depressed opening 130 defines triple through holes 131 extending through the lower wall 13 and communicated with the rectangular slot 102.

Referring to FIGS. 1–4, the second housing piece 2 of the present invention is made of PVC material. In other embodiments, the second housing piece 2 also can be made from other material, same as that of the front first housing piece 1 or different from that of the first housing piece 1. The second housing piece 2 comprises a main portion 20, a second projecting portion 21 forwardly projecting extending from a front surface of the main portion 20, and a first projecting portion 29 forwardly extending from a front surface of the second projecting portion 21. The main portion 20 is larger than the second projecting portion 21 in structure, the second projecting portion 21 is larger than the first projecting portion 29, thereby forming a continued step-shape configuration therebetween. The main portion 20 defines a top surface 201 coplanar with the top surface of the upper wall 12 of the first housing piece 1. A pair of anti-fishhook ribs 28 extends upwardly from the top surface 201 such that it has a height which is great than the main portion 20. A pair of anti-overstress arms 280 extends from the top of the anti-fishhook rib 28 towards another anti-fishhook rib 28, thereby forming an operation space between the anti-overstress arms 280 and the top surface 201 of the main portion 20. The anti-fishhook ribs 28 prevent the latch 5 from snagging or fishhooking conductive leads used in proximity to the connector housing. The anti-overstress arms 280 prevent over deflection of the latch 5 away from the top surface 201 of the main portion 20. Further, a pair of ribs 25 are spaced and located between the pair of anti-fishhook ribs 28 with a height lower than that of the anti-overstress arms 280.

Figure 2:
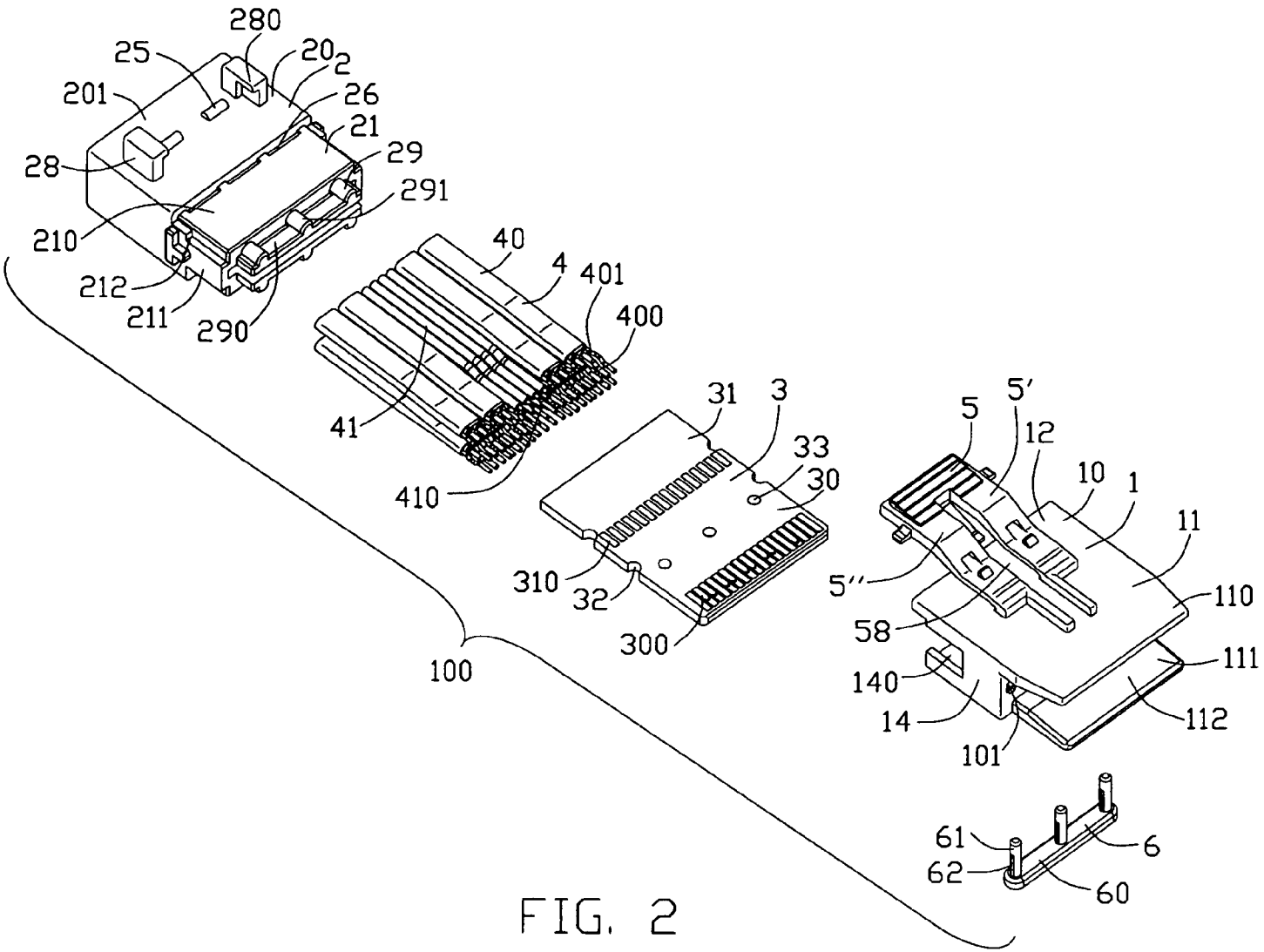
FIG. 2 is an exploded, perspective view of the cable connector assembly shown in FIG. 1.
Figure 3:
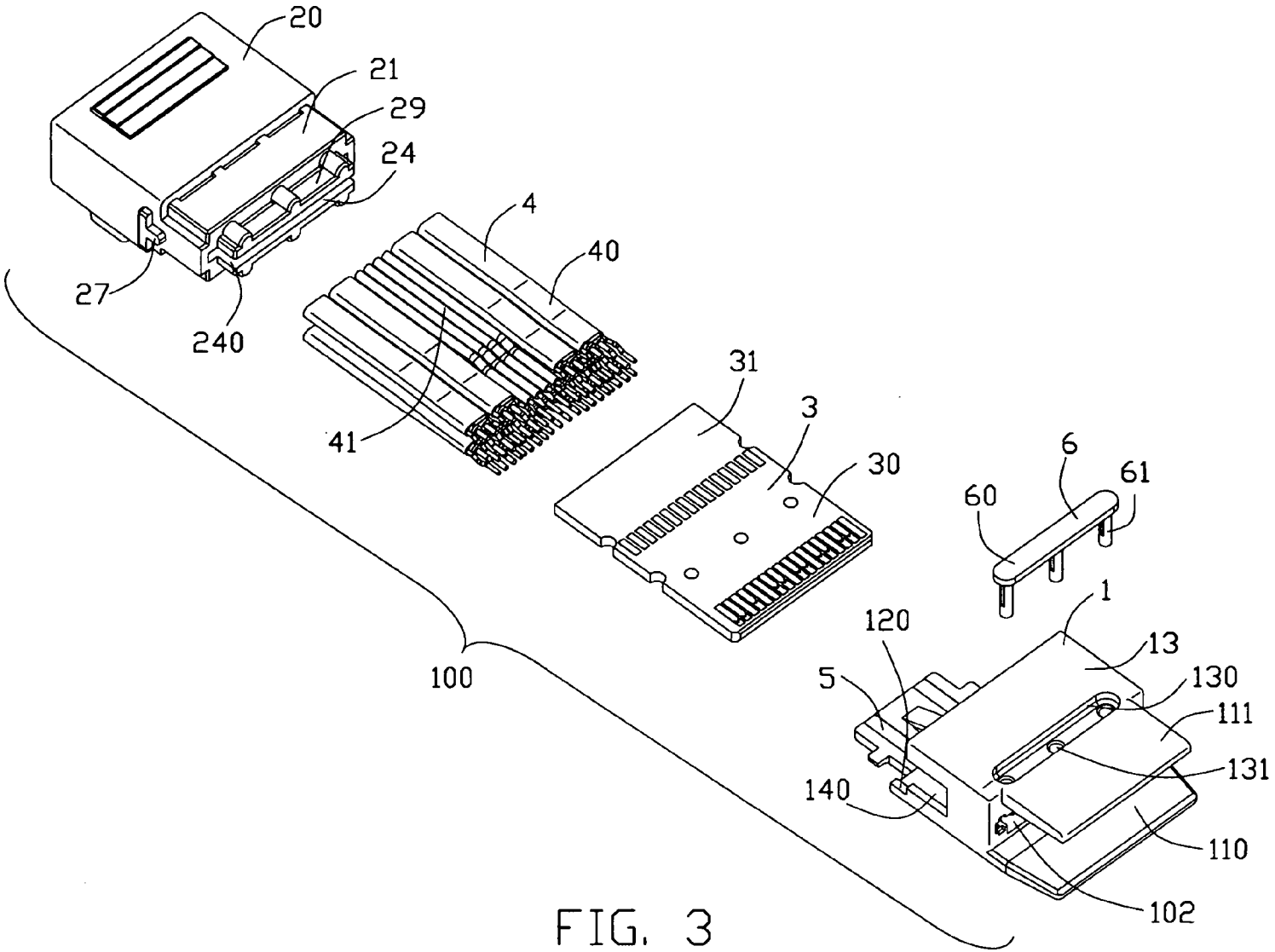
FIGS. 3–4 are views similar to FIG. 2, but taken from different aspects.
Figure 4:
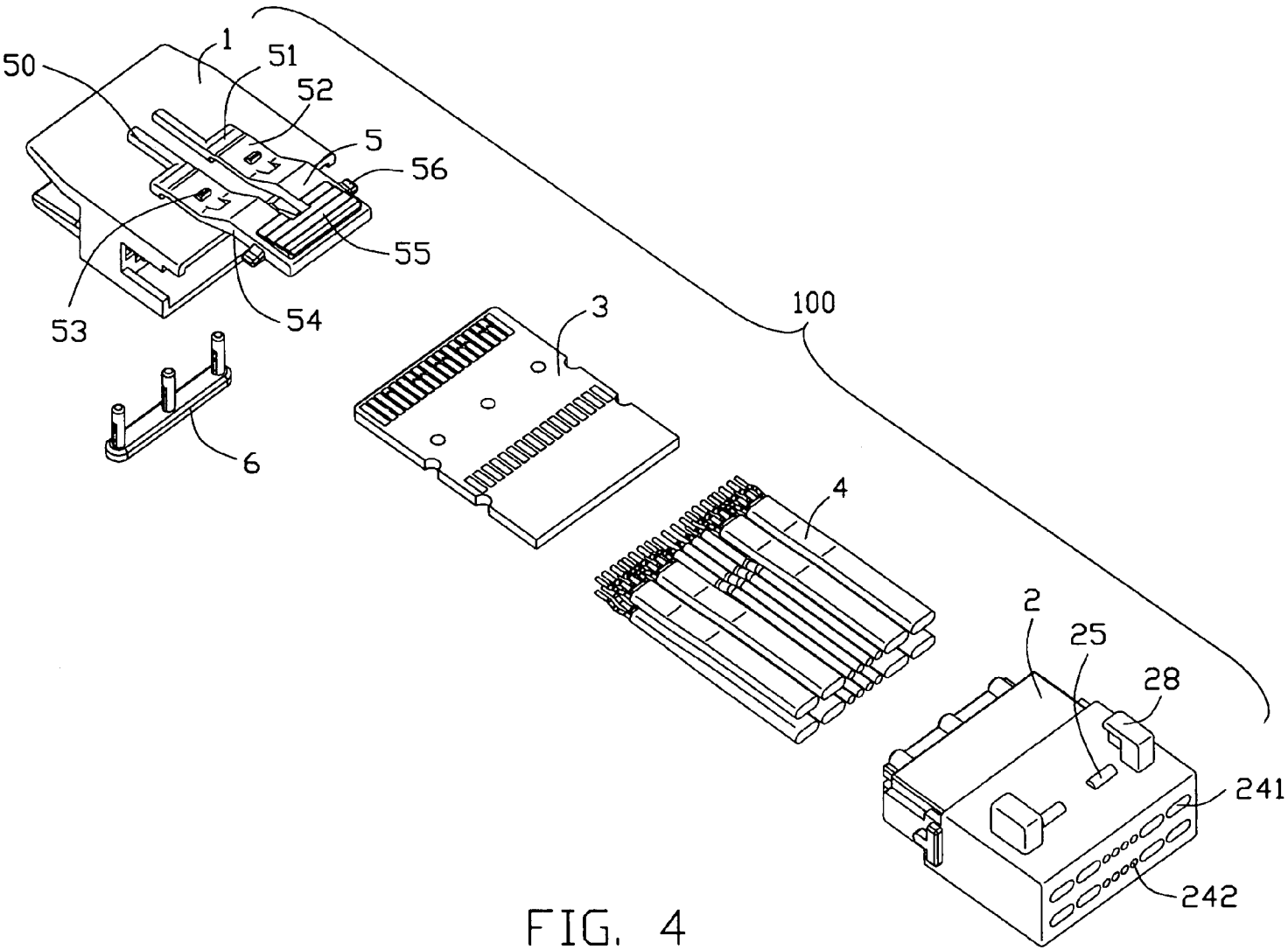
Figure 5:
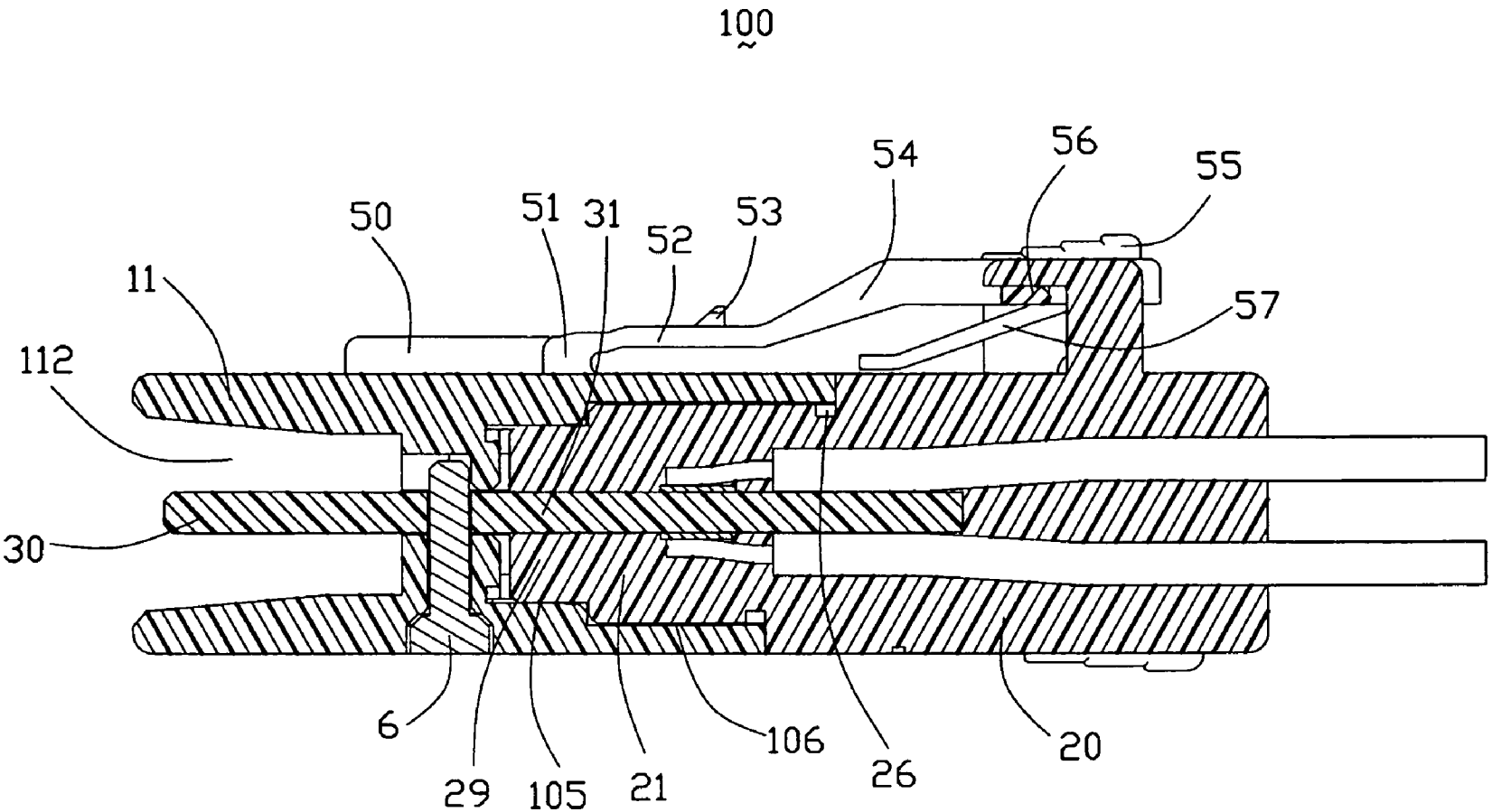
FIGS. 5–7 are cross-sectional views of the cable connector assembly respectively taken from lines 5—5, 6—6 and 7—7 of FIG. 1.
Figure 6:
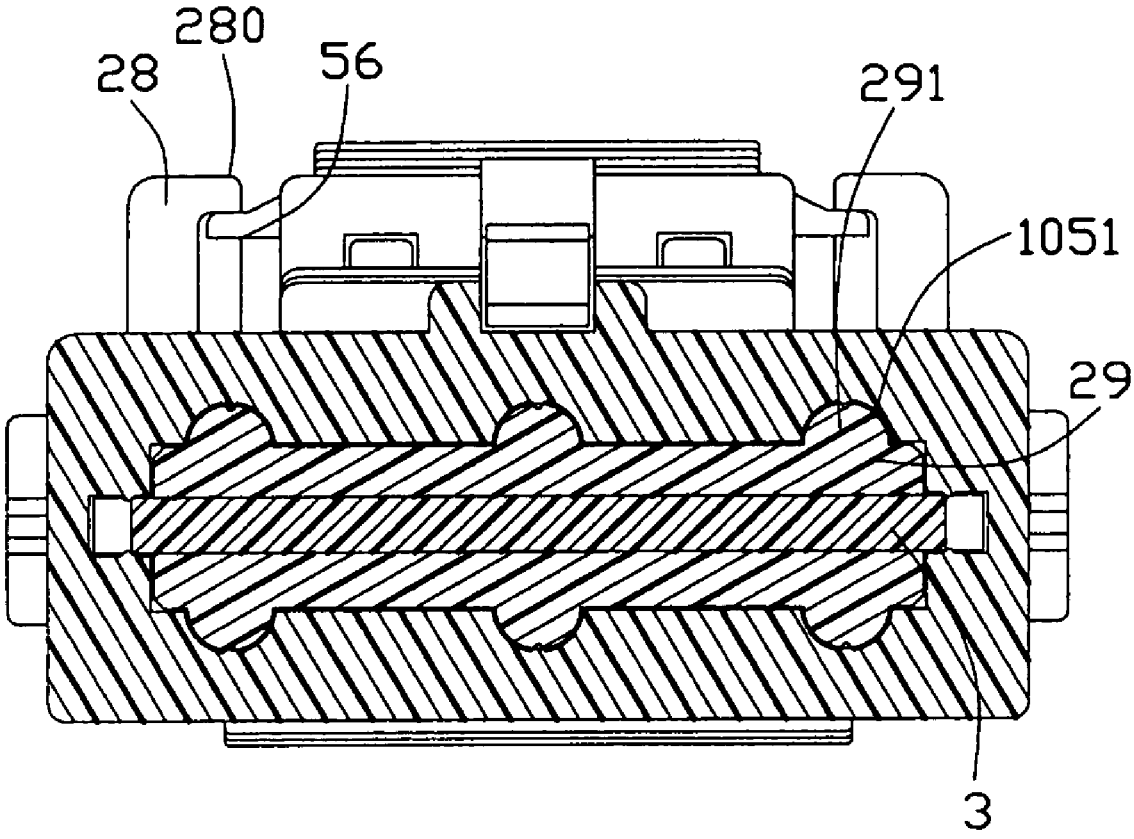
Figure 7:
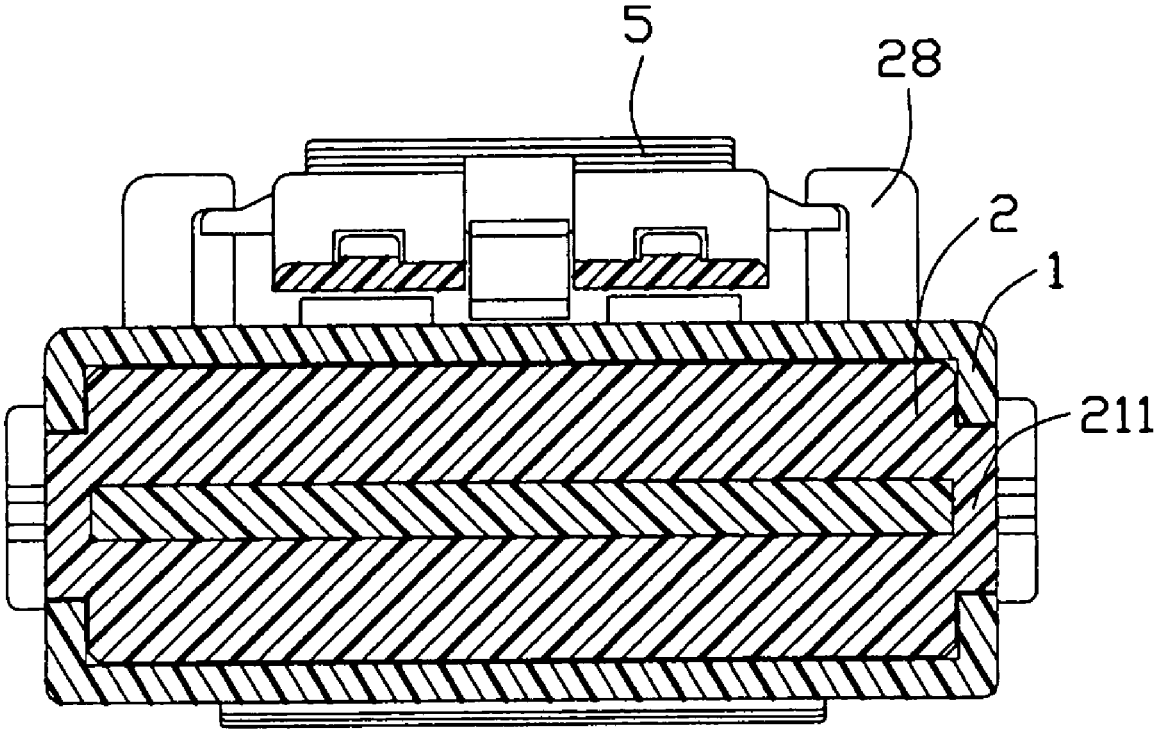

Referring to FIGS. 2–3, the second projecting portion 21 comprises a substantially rectangular main portion 210, a pair of protrusions 211 outwardly extending from two lateral walls of the main portion 210. Each protrusion 211 comprises a step base 212 for abutting against the cutout 140 of the first housing piece 1. The first projecting portion 29 is formed of two-piece board 290 opposite to each other. Each board 290 comprises triple semi-circular bulges 291 aligned with corresponding semi-circular holes 1051. The second housing piece 2 further comprises a pair of "T" shape bars 27 formed at two lateral surfaces thereof and adjacent to the step base 212 for providing stop function when assembled with the complementary connector, a receiving slit 240 extending through the first and second projecting portion 29, 21 for receiving the printed circuit board 3 therein, and a plurality of first and second cable receiving slits 241, 242 communicated with the receiving slit 24 for respective receiving the cables 4 therein. The receiving slit 240 and the first and second cable receiving slits 241, 242 together are regarded as the receiving part.

The printed circuit board 3 forms a plurality of first conductive pads 300 at a mating portion 30 thereof and a plurality of second conductive pads 310 at a rear portion 31 thereof. The conductive pads 300, 310 are arranged on opposite upper and lower surfaces of the printed circuit board 3. Triple through holes 33 are disposed between the first and second conductive pads 300, 310. Each side edge of the printed circuit board 3 defines a pair of semi-circular positioning holes 32 arranged along the mating direction. To realize hot plug function, the first conductive pads 300, which are used for signal transmission, are formed with V-shape cutouts (not labeled) to let the first conductive pads 300, which are used for grounding, to mate with the complementary connector firstly and break from the complementary connector lastly. Such V-shape cutout structure assures the signal transmission without dimple. Of course, the V-shape cutout also can be omitted here or have other configurations.

The cables 4 consist of two sets of sub-assemblies in a stacked relationship. Each set comprises four serial Attached Technology Attachment (ATA) standard cables 40 for high speed signal transmission and four single ended wires 41 for low speed signal transmission. Each Serial ATA standard cable 40 comprises a pair of signal conductors 400 respectively transmitting positive signal and negative signal, and a pair of grounding conductors 401 arranged at opposite outer sides of the pair of signal conductors 400 for providing grounding to the signal transmission. Each wire 41 comprises a single conductor 410, and an insulator (not labeled) enclosing the single conductor 410.

The pin member 6 comprises a longitudinal strip 60 that can be received in the depressed opening 130, and triple columned pins 61 extending from the strip 60 with a diameter generally equal to that of the through holes 131 of the first housing piece 1 and the through holes 33 of the printed circuit board 3 such that the pins 61 can extend through said through holes 131, 33. Each pin 61 further comprises at least one rib 62 thereon for providing an interference fit with the through holes 131 and holding the printed circuit board 3 with the first housing piece 1 reliably.

Referring to FIGS. 2–5, the/latch 5 is molded unitarily with the first housing piece 1 and extends unitarily from the generally horizontal top surface of the upper wall 12. In particular, the latch 5 comprises a first latch piece 5', a second latch piece 5" in spaced relationship to the first latch piece 5' and forming a gap 58 between the first latch piece 5' and the second latch piece 5", a depressible actuator 55 unitarily molded with the free ends of the first latch piece 5' and the second latch piece 5", and a third latch piece 57 downwardly and forwardly extending from the depressible actuator 55 towards the top surface of the upper wall 12. The depressible actuator 55, the first and second latch piece 5', 5" together forms a substantially "ㄱ" shape configuration. The first latch piece 5' is same as the second latch piece 5" in structure, and each comprises a base portion 51 which extends unitarily from the top surface of the upper wall 12 and located adjacent to the rear edge of the tongue section 110, a deflectable portion 52 rearwardly extending away from the base portion 51 in spaced relationship to and substantially parallel to the top surface of the upper wall 12, and an elevated portion 54 rearwardly extending from the deflectable portion 52 and with a substantially "v" shape cross-sectional view. A locking protrusion 53 extends from the deflectable portion 52 for locking with a locking aperture (not shown) of the complementary connector. Further, the rear edges of the pair of elevated portion 54 are molded with the depressible actuator 55. In particular, the depressible actuator 55 substantially corresponds to a location of maximum deflectability along the latch 5 and is substantially parallel to the top surface of the upper wall 12. As result of this construction, a force exerted on the depressible actuator 55 to urge the latch 5 toward the top surface of the upper wall 12 will disengage the locking protrusions 53 from the locking apertures in the complementary connector. The third latch piece 57 with a strip shape downwardly and forwardly extends from a bottom surface of the depressible actuator 55. The tip end of the third latch piece 57 is parallel to the top surface of the upper wall 12, and can slide inwardly along the top surface of the upper wall 12 along the mating direction. In particular, before a force is exerted on the depressible actuator 55, the tip end of the third latch piece 57 is adjacent to and forms slightly distance from the top surface of the upper wall 12. Obviously, in another embodiment, the tip end of the third latch 57 is in contact with the top surface of the upper wall in an initial state without departing from the spirit of the instant invention. In particular, a pair of ledges 56 are molded unitarily with the depressible actuator 55 to laterally extend orthogonally to the mating direction. Further, the first housing piece 1 comprises a pair of plastic keys 50 forwardly extending from the inner edges of the base portion 51 and spaced from each other for mating orientation with the complementary connector. These two plastic keys 50 form a slot (not labeled) therebetween communicated with the gap 58 of the latch 5.

Referring to FIGS. 1–7, in assembly of the cable connector assembly 100, the two sets of cables 4 are respectively soldered to the second conductive pads 310 located on the upper and lower surfaces of the printed circuit board 3. The second housing piece 2 is then over-molded to the joints of the printed circuit board 3 and the cables 4 with the rear portion 31 of the printed circuit board 3 received in the receiving slit 24, the front ends of the first and second cables 40, 41 received in the first and second cable receiving slits 241, 242 of the second housing piece 2. The pair of semi-circular positioning holes 32 located at a relatively rear position are filled with material of the second housing piece 2 to increase the retaining force between the second housing piece 2 and the printed circuit board 3.

Referring to FIGS. 2–7, the second housing piece 2 with the cables 4 and the printed circuit board 3 is assembled to the first housing piece 1 along the mating direction. First, the pair of protrusions 211 of the second projecting portion 21 slides into the cutouts 140 of the lateral walls 14, the mating portion 30 of the printed circuit board 3 protrudes through the receiving slot 101 to be exposed between the first and second tongue sections 110, 111 until the step portion 120 of the first housing piece 1 fitly mates with the step base 212. Thus, the first and second projecting portions 29, 21 respectively are received in the first and second receiving cavities 105, 106 with the semi-circular bulges 291 being received in corresponding semi-circular holes 1051. Thus, the first housing piece 1 and the second housing 2 are combined with each other with no clearance therebetween. In particular, the through holes 33 of the printed circuit board 3 respectively align with the through holes 131 of the first housing piece 1. The ledges 56 of the latch 5 are respectively located below the anti-overstress arms 280 and prevented from being pushed outwardly away from the top surface 201 of the second housing piece 2. Further, to enhance the combination of the printed circuit board 3 and the front housing piece 1, the pin member 6 is employed. The strip 60 of the pin member 6 is received in and substantially covers the depressed opening 130 with triple pins 61 being inserted through the through holes 131 of the first housing piece 1, the through holes 33 of the printed circuit board 3. The tip ends of the pins 61 are arranged in the rectangular slot 102. The ribs 62 of the pins 61 abut against the inner surfaces of the through holes 131 for providing an interference fit and ensuring a reliable connection between the first housing piece 1 and the pin member 6. In addition, to enhance the combination of the first and rear housing pieces 1, 2, the present invention also spreads glue to the first and second projecting portion 29, 21 before assembling the second housing piece 2 to the first housing piece 1. In addition, a plurality of cutouts 26 formed in the second housing piece 2 are used to receive excrescent glue after assembly.

When the cable connector assembly 100 is forwardly pushed and engaged with the complementary connector, a downwardly force exerted on the depressible actuator 55 drives the first and second latch pieces 5', 5" to rotate relative to the base portion 51 and move close to the top surfaces 201 of the first and second housing pieces 1, 2, thereby allowing the locking protrusions 53 to align with the locking apertures of the complementary connector. During this process, the third latch piece 57 abuts against and slides along the top surfaces 201 of the first and second housing piece 1, 2, thereby causing the third latch piece 57 to generate an opposing force. This opposing force drives the latch 5 to rotate to an original state such that the locking protrusions 53 can lock with the locking apertures by this restorative opposing force. In addition, when the depressible actuator 55 is pressed excessively, the third latch piece 57 can slide through the gap 58 between the first and second latch pieces 5', 5", and the first and second latch pieces 5' and 5" can be blocked by the ribs 25 of the second housing piece 2 for preventing the latch 5 being pushed downwardly excessively. The process to unmate the cable connector assembly 100 with the complementary connector is similar to above mating process. In addition, for preventing the latch 5 being pulled away from the top surface 201 of the second housing piece 2, the anti-overstress arms 280 and the ledges 56 are employed, and the ledges 56 can be regarded as an anti-overstress means. In addition, the top surface 201 of the second housing piece 2, the top surface of the upper wall 12, together can be regarded as an external surface of the connector housing. And, the deflectable portion 52, and the elevated portion 54 together can be regarded as the deflectable arm.

Further, in another embodiment, the latch 5 with the first, second and third latch pieces 5', 5" and 57 also can be employed on the connector housing (shown in FIG. 22) of the U.S. Pub. No. 2006/0009080A1 to achieve a latch function without departing from the spirit of the instant invention. In this embodiment, after the printed circuit board is electrically connected with the cable, the connector housing with the unitary latch is molded with the printed circuit board and the cable. This way can save time spent on assembly the first housing piece 1 to the second housing piece 2. Obviously, in another embodiment, the first housing piece 1 and second housing piece 2 can be designed to assemble together along a direction perpendicular to the mating direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly for mating with a complementary connector comprising a connector housing comprises a first housing piece and a second housing piece assembled to the first housing along the mating direction; each connector housing defining a mating interface and a mating direction, and having at least one external surface;

a resilient latch having a base portion molded on said exterior surface of the first housing piece, and a deflectable arm extending from the base portion in spaced relationship to said exterior surface of the first housing piece and defining an engagement structure for engaging with a corresponding structure on the complementary connector, and a depressible actuator extending from the deflectable arm;

anti-overstress means unitarily molded with and laterally extending from at least one of the deflectable arm and the depressible actuator; and a pair of anti-fishhook ribs extending from the external surface of the second housing piece in spaced relationship to said deflectable arm, and having anti-overstress arms extending from at least one of said anti-fishhook ribs for limiting deflection of said deflectable arm of said latch relative to said external surface of the second housing piece; and spring means unitarily connected to at least one of the deflectable arm and the depressible actuator, and extending toward the external surfaces for providing enough spring when an actuating force is applied to said latch;

the latch comprises a first latch piece, a second latch piece in spaced relationship to the first latch piece along a direction perpendicular to the mating direction;

the first latch piece is similar to the second latch piece in structure, and each comprises the base portion unitarily with the external surface of the first housing piece, the deflectable arm rearwardly extending from the base portion with the engagement structure formed thereon;

the spring means with a strip shape is unitarily molded with the depressible actuator, and extends downwardly and forwardly toward the external surface.

2. The electrical connector as claimed in claim 1, wherein the base portion is molded on a position of the external surface of the first housing piece where is spaced a distance from the mating interface, and at least a plastic key is formed within said distance for mating orientation with the complementary connector.

3. The electrical connector as claimed in claim 1, wherein the mating interface of the first housing piece comprises a pair of tongue sections and an opening defined between the tongue sections.

4. The electrical connector as claimed in claim 3, wherein the external surface of the second housing piece further comprises a pair of ribs located between the pair of anti-fishhook ribs and with a height lower than that of the anti-overstress arms for bring the first and second latch pieces so as to prevent the latch to be pushed excessively.

5. The electrical connector as claimed in claim 3, wherein one free end of the spring means is adjacent to and slightly distanced from the external surface of the second housing piece before the actuating force is applied to the depressible actuator.

6. The electrical connector as claimed in claim 3, wherein one free end of the spring means is in contact with the external surface of the connector housing before the actuating force is applied to the depressible actuator, and slide along the external surface of the second housing piece when the actuating force is applied to the depressible actuator.

7. The electrical connector as claimed in claim 3, wherein the depressible actuator is unitarily molded with the first and second latch pieces, and the first and the second latch pieces together define a gap where the spring means can extend through.

8. The electrical connector as claimed in claim 7, wherein the spring means is located below the depressible actuator, and can extend through the gap between the first and second latch pieces when the actuating force is applied to the depressible actuator.

9. A cable connector assembly for mating with a complementary connector comprising:

a connector housing comprises a first housing piece and a second housing piece assembled to the first housing along the mating direction; each connector housing defining a mating interface and a mating direction, and having at least one external surface;

a printed circuit board circuit board received in the connector housing pieces and defining a mating portion accessible from the mating interface;

a cable with a plurality of conductors electrically connected to the printed circuit board; and a latch comprises a first latch piece, a second latch piece, the latch unitarily molded with the external surface of the first connector housing and having an engagement structure for engaging with a complementary structure of the complementary connector;

each resilient latch having a base portion molded on said exterior surface of the first housing piece, and a deflectable arm extending from the base portion in spaced relationship to said exterior surface of the first housing piece and defining an engagement structure for engaging with a corresponding structure on the complementary connector, and a depressible actuator extending from the deflectable arm;

anti-overstress means unitarily molded with and laterally extending from at least one of the deflectable arm and the depressible actuator; and a pair of anti-fishhook ribs extending from the external surface of the second housing piece in spaced relationship to said deflectable arm, and having anti-overstress arms extending from at least one of said anti-fishhook ribs for limiting deflection of said deflectable arm of said latch relative to said external surface of the second housing piece; and the latch further comprises a third latch unitarily molded with a bottom surface of the depressible actuator, and forwardly and downwardly extending toward the external surface of the connector housing.

10. The cable connector assembly as claimed in claim 9, wherein the latch comprises a first latch piece, and a second latch piece in spaced relationship to the first latch piece along a direction perpendicular to the mating direction.

11. The cable connector assembly as claimed in claim 9, wherein the latch further comprises a depressible actuator respectively molded with the first and second latch pieces, and thereby together forming a substantially "1-'1" shape configuration.

12. The cable connector assembly as claimed in claim 9, wherein the mating interface comprises a pair of tongue sections and an opening defined between the tongue sections, a mating portion of the printed circuit board is exposed in the opening.

13. The cable connector assembly as claimed in claim 12, wherein the latch further comprises a pair of ledges respectively laterally extending from the depressible actuator, and the connector housing further comprises a pair of anti-overstress arms, the pair of ledges are obstructed by the anti-overstress arms for preventing the latch to be rotated away from the external surface of the first housing piece.

* * * * *